US005551099A

United States Patent [19]

Kirk

[11] Patent Number: 5,551,099

[45] Date of Patent: Sep. 3, 1996

[54] WEIGHTED POOL COVER PERIMETER ANCHOR

[76] Inventor: Richard A. Kirk, 335 Redwood Grove Ct., Millersville, Md. 21108

[21] Appl. No.: 386,148

[22] Filed: Feb. 9, 1995

[51] Int. Cl.[6] ..... E04H 4/10

[52] U.S. Cl. ..... 4/503.000

[58] Field of Search ..... 4/494, 496, 498, 4/503, 506, 585; 135/116, 156

[56] References Cited

U.S. PATENT DOCUMENTS

| | | | |
|---|---|---|---|
| 2,883,676 | 4/1959 | Kwake | 4/503 |
| 2,964,759 | 12/1960 | Riggs | 4/498 |
| 3,667,070 | 6/1972 | Pitti et al. | 4/503 |
| 3,711,873 | 1/1973 | Katzman | 4/503 |
| 4,458,668 | 7/1984 | Sheldon | 4/498 X |
| 4,897,925 | 7/1989 | Perry | 4/503 X |

*Primary Examiner*—Robert M. Fetsuga

[57] ABSTRACT

An anchor for securing a perimeter of a cover about a pool. The inventive device includes an elongated anchor assembly positionable about a perimeter of the pool. Securing straps couple the anchor assembly to the perimeter edge of a cover extending over the pool. The anchor assembly is preferably formed of a plurality of conduits which can be filled with water to increase a weight of the anchor assembly to a desired amount.

4 Claims, 3 Drawing Sheets

FIG. 2
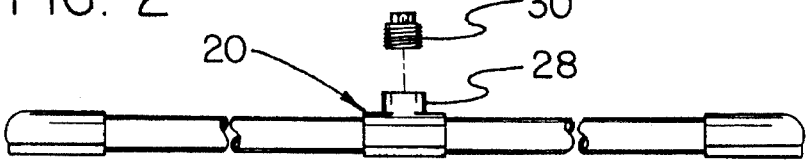
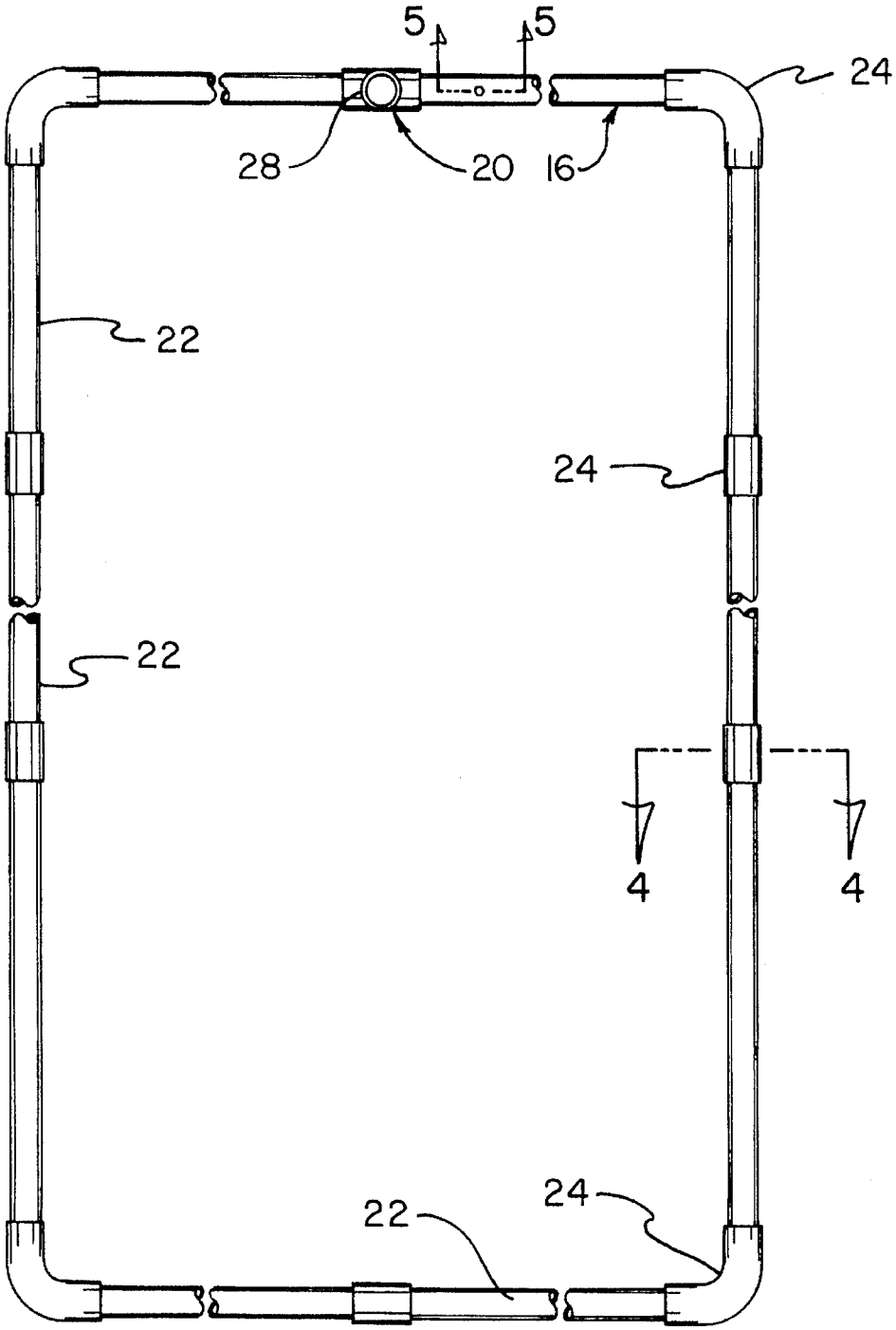
FIG. 3

WEIGHTED POOL COVER PERIMETER ANCHOR

BACKGROUND OF THE INVENTION

1. Field of the Invention

The present invention relates to covering devices and more particularly pertains to an weighted pool cover perimeter anchor for securing a perimeter of a cover about a pool.

2. Description of the Prior Art

The use of covering devices is known in the prior art. More specifically, covering devices heretofore devised and utilized are known to consist basically of familiar, expected and obvious structural configurations, notwithstanding the myriad of designs encompassed by the crowded prior art which have been developed for the fulfillment of countless Objectives and requirements.

Known prior art covering devices include U.S. Pat. No. 3,520,004; U.S. Pat. No. 4,815,152; and U.S. Pat. No. 5,068,929.

While these devices fulfill their respective, particular objectives and requirements, the aforementioned patents do not disclose a weighted pool cover perimeter anchor for securing a perimeter of a cover about a pool which includes an elongated anchor means positionable about a perimeter of a pool, and securing straps coupling the anchor means to the perimeter edge of a cover extending over the pool, whereby the anchor means includes a plurality of conduits which can be filled with water to increase a weight of the anchor assembly to a desired amount for securing the cover relative to the pool.

In these respects, the weighted pool cover perimeter anchor according to the present invention substantially departs from the conventional concepts and designs of the prior art, and in so doing provides an apparatus primarily developed for the purpose of securing a perimeter of a cover about a pool.

SUMMARY OF THE INVENTION

In view of the foregoing disadvantages inherent in the known types of covering devices now present in the prior art, the present invention provides a new weighted pool cover perimeter anchor construction wherein the same can be utilized for securing a perimeter of a cover about a pool. As such, the general purpose of the present invention, which will be described subsequently in greater detail, is to provide a new weighted pool cover perimeter anchor apparatus and method which has many of the advantages of the covering devices mentioned heretofore and many novel features that result in a weighted pool cover perimeter anchor which is not anticipated, rendered obvious, suggested, or even implied by any of the prior art covering devices, either alone or in any combination thereof.

To attain this, the present invention generally comprises an anchor for securing a perimeter of a cover about a pool. The inventive device includes an elongated anchor assembly positionable about the perimeter of the pool. Securing straps couple the anchor assembly to the perimeter edge of a cover extending over the pool. The anchor assembly is preferably formed of a plurality of conduits which can be filled with water to increase a weight of the anchor assembly to a desired amount.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new weighted pool cover perimeter anchor apparatus and method which has many of the advantages of the covering devices mentioned heretofore and many novel features that result in a weighted pool cover perimeter anchor which is not anticipated, rendered obvious, suggested, or even implied by any of the prior art covering devices, either alone or in any combination thereof.

It is another object of the present invention to provide a new weighted pool cover perimeter anchor which may be easily and efficiently manufactured and marketed.

It is a further object of the present invention to provide a new weighted pool cover perimeter anchor which is of a durable and reliable construction.

An even further object of the present invention is to provide a new weighted pool cover perimeter anchor which is susceptible of a low cost of manufacture with regard to both materials and labor, and which accordingly is then susceptible of low prices of sale to the consuming public, thereby making such weighted pool cover perimeter anchors economically available to the buying public.

Still yet another object of the present invention is to provide a new weighted pool cover perimeter anchor which provides in the apparatuses and methods of the prior art some of the advantages thereof, while simultaneously overcoming some of the disadvantages normally associated therewith.

Still another object of the present invention is to provide a new weighted pool cover perimeter anchor for securing a perimeter of a cover about a pool.

Yet another object of the present invention is to provide a new weighted pool cover perimeter anchor which includes an elongated anchor means positionable about a perimeter of a pool, and securing straps coupling the anchor means to the perimeter edge of a cover extending over the pool, whereby the anchor means includes a plurality of conduits which can be filled with water to increase a weight of the anchor assembly to a desired amount for securing the cover relative to the pool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an end elevation view thereof.

FIG. 3 is a top plan view of the weighted pool cover perimeter anchor.

DESCRIPTION OF THE PREFERRED EMBODIMENT

Figure 1:
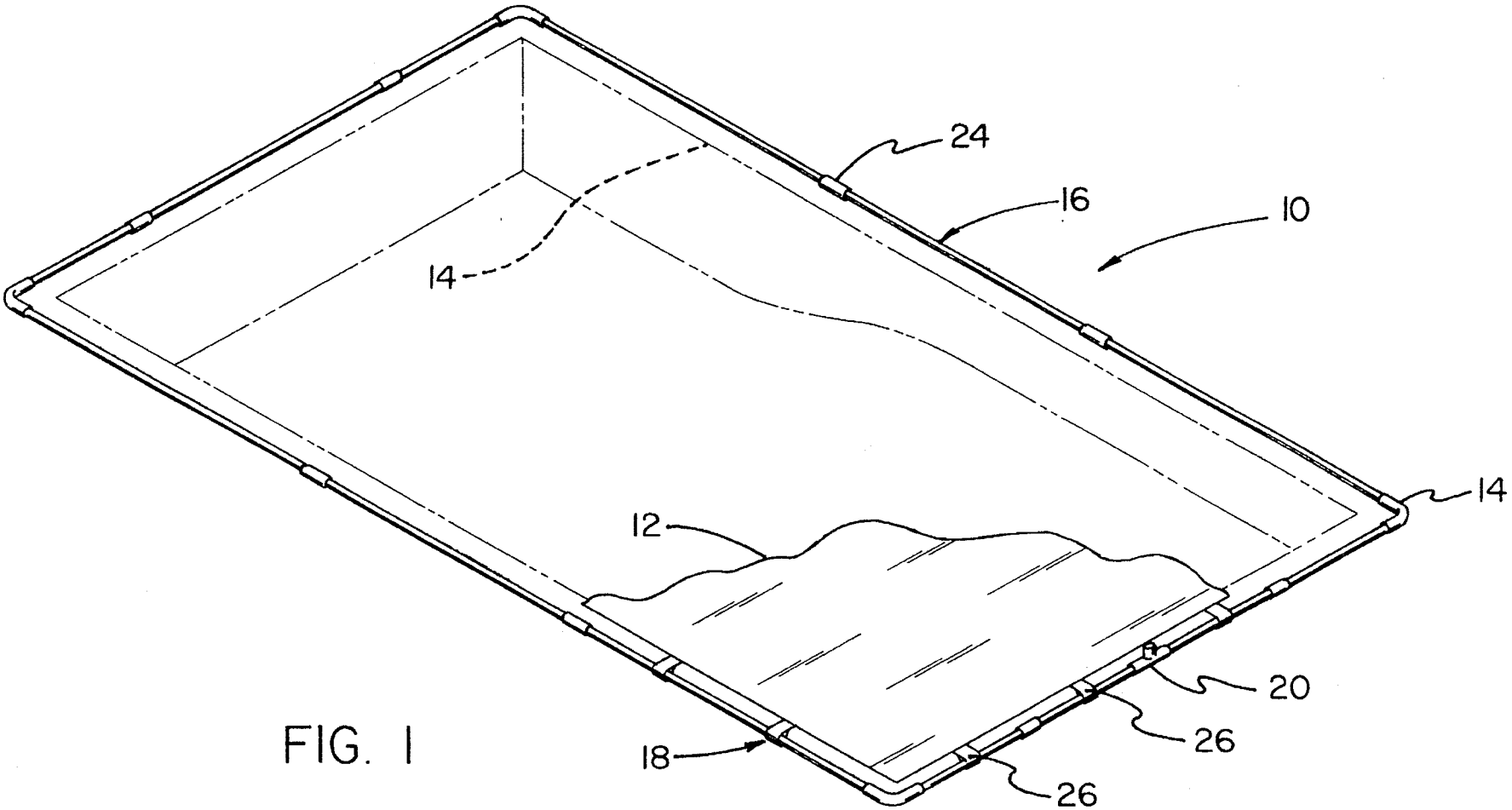
FIG. 1 is an isometric illustration of a weighted pool cover perimeter anchor according to the present invention in use.

With reference now to the drawings, and in particular to FIGS. 1–5 thereof, a new weighted pool cover perimeter anchor embodying the principles and concepts of the present invention and generally designated by the reference numeral 10 will be described.

More specifically, it will be noted that the weighted pool cover perimeter anchor 10 comprises a substantially rectangular cover 12 for positioning over a pool 14 to preclude entrance of debris into the pool during periods of non-use thereof. An elongated anchor means 16 extends about a perimeter of the cover 12 for anchoring the cover relative to the pool 14. Securing means 18 are coupled to the cover 12 for removably coupling the cover to the elongated anchor means 16. A filling means 20 is coupled to and positioned in fluid communication with the elongated anchor means 16 for selectively permitting an introduction of fluid into the elongated anchor means to increase a weight of the anchor means as desired.

As best illustrated in FIGS. 2 through 5, it can be shown that the elongated anchor means 16 according to the present invention 10 comprises a plurality of elongated conduits 22 connected together in fluid communication by a plurality of connectors 24. The connectors 24 include straight connectors which couple adjacent elongated conduits 22 together in a substantially collinear orientation relative to one another, and angled connectors which couple adjacent conduits together in a substantially orthogonal orientation. By this structure, the elongated anchor means 16 is configured to extend about a perimeter of the cover 12 positioned over the pool 14.

As shown in FIG. 1, the securing means 18 according to the present invention 10 preferably comprises a plurality of straps 26 which are mounted to the cover 12 and extend about the elongated anchor means 16. The straps 26 thus extend about the elongated conduits 22 of the elongated anchor means 16 to couple back with the cover 12 through the use of unillustrated fastening means such as "VELCRO" hook and loop fastener, mechanical snaps, or the like. By this structure, the securing means 18 can be selectively released from the elongated anchor means 16 to permit use of the pool 14 and storage of the cover 12 as desired.

Referring now to FIG. 2, it can be shown that the filling means 20 according to the present invention 10 comprises a T-connector 28 positioned in fluid communication with at least one of the elongated conduits 22 of the elongated anchor means 16. The T-connector 28 of the filling means 20 includes a removable plug 30 permitting the introduction of water or other weighted fluids, such as an antifreeze mixture or the like, into the anchor means 16 to increase a weight thereof.

Figure 5:
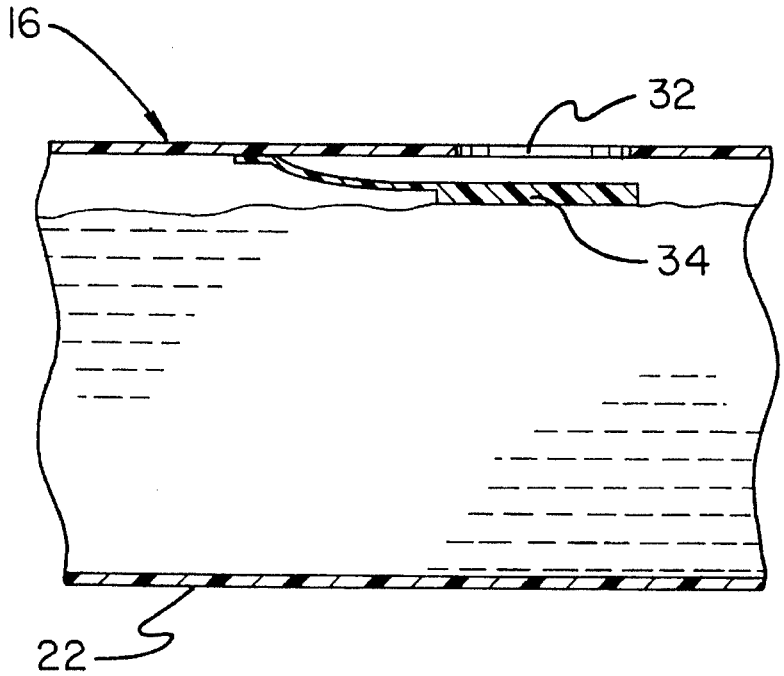
FIG. 5 is a cross sectional view taken along line 5—5 of FIG. 3.

As shown in FIG. 5, one of the elongated conduits 22 of the anchor means 16 preferably includes a vent aperture 32 directed therethrough which cooperates with the filling means 20 to facilitate ease of injection of a weighted fluid thereinto. Preferably, a buoyant valve plate 34 is pivotally mounted to an interior surface of the elongated conduit 22 through which the vent aperture 32 is directed, thereby to close the vent aperture 32 upon a complete filling of fluid within the elongated anchor means 16.

Figure 4:
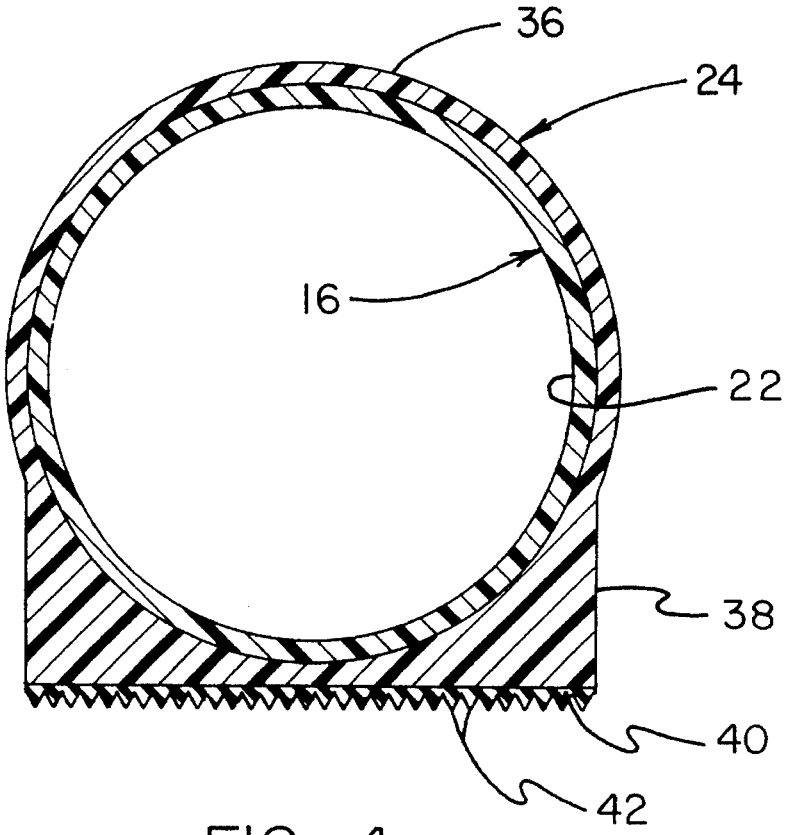
FIG. 4 is a cross sectional view taken along line 4—4 of FIG. 3.

As shown in FIG. 4, the connectors 24 according to the present invention 10 preferably each comprise a cylindrical member 36 positionable over the elongated conduits 22 of the anchor means 16. A mounting base 38 desirably extends from the cylindrical member 36 to terminate in a planar lower surface having an elastomeric pad 40 extending therealong for engagement with a surface adjacent to the pool 14. Preferably, the elastomeric pad 40 includes a plurality of engaging projections 42 and extending therefrom for enhancing frictional engagement between the elastomeric pad and the surface surrounding the pool 14. By this structure, the connectors 24 provide enhanced frictional engagement of the anchor means 16 relative to the surface surrounding the pool 14 to preclude a pulling of the cover 12 into the pool.

In use, the weighted pool cover perimeter anchor 10 according to the present invention can be easily utilized in combination with the cover 12 to effect securing of the cover about the perimeter of the pool 14 during periods of non-use of the pool.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A weighted pool cover perimeter anchor, comprising:

an elongated anchor means extending about the perimeter of a pool cover which is positioned over a pool to anchor such cover relative to such pool, said anchor means comprising a plurality of elongated conduits connected together in fluid communication by a plurality of connectors;

securing means comprising a plurality of straps which are mountable to the cover and extend about the elongated anchor means to removeably couple said cover to said anchor means;

and, a filling means coupled to and in fluid communication with said conduits of said anchor means to selectively permit introduction of fluid into said conduits wherein the filling means comprises a T-connector positioned in fluid communication with at least one of the elongated conduits of the elongated anchor means, the T-connector of filling means including a removable plug permitting the introduction of a fluid into the anchor means.

2. The weighted pool cover perimeter anchor of claim 4, wherein one of the elongated conduits of the anchor means includes a vent aperture directed therethrough which cooperates with the filling means to facilitate ease of injection of said fluid thereinto; and further comprising a buoyant valve plate pivotally mounted to an interior surface of the one of the elongated conduits through which the vent aperture is directed, thereby to close the vent aperture upon a complete filling of fluid within the elongated anchor means.

3. The weighted pool cover perimeter anchor of claim 2, wherein the connectors each comprise a cylindrical member positionable over adjacent elongated conduits of the anchor means, a mounting base extending from the cylindrical member to terminate in a planar lower surface; and an elastomeric pad extending along the planar lower surface for engagement with a surface adjacent to the pool over which such cover is positioned.

4. The weighted pool cover perimeter anchor of claim 3, wherein the elastomeric pad includes a plurality of engaging projections extending therefrom for enhancing frictional engagement between the elastomeric pad and a surface surrounding the pool over which such cover is positioned.

* * * * *